US008483404B2

(12) United States Patent
Bogdan et al.

(10) Patent No.: US 8,483,404 B2
(45) Date of Patent: Jul. 9, 2013

(54) SYSTEM INCLUDING DEVICE FOR SECURING THE STATES OF ELECTRONIC CONTROLS

(75) Inventors: John B. Bogdan, Providence, UT (US); Robin M. Urry, Draper, UT (US); John D. Hanson, West Jordan, UT (US)

(73) Assignee: Harman International Industries, Incorporated, Northridge, CA (US)

( * ) Notice: Subject to any disclaimer, the term of this patent is extended or adjusted under 35 U.S.C. 154(b) by 1128 days.

(21) Appl. No.: 12/104,975

(22) Filed: Apr. 17, 2008

(65) Prior Publication Data

US 2009/0262953 A1 Oct. 22, 2009

(51) Int. Cl.
*G10H 1/32* (2006.01)

(52) U.S. Cl.
USPC ..... 381/87

(58) Field of Classification Search
USPC ..... 381/61–64, 87
See application file for complete search history.

(56) References Cited

U.S. PATENT DOCUMENTS

| | | | | |
|---|---|---|---|---|
| 4,445,415 | A * | 5/1984 | Izquierdo | 84/177 |
| 4,623,992 | A | 11/1986 | Kurosaki et al. | |
| 4,733,806 | A * | 3/1988 | Sloop | 206/316.2 |
| 5,866,829 | A * | 2/1999 | Pecoraro | 84/177 |
| 6,215,055 | B1 * | 4/2001 | Saravis | 84/422.1 |
| 7,546,920 | B1 * | 6/2009 | Horn et al. | 206/317 |

FOREIGN PATENT DOCUMENTS

EP 1435766 A1 7/2004

* cited by examiner

*Primary Examiner* — David Vu
*Assistant Examiner* — Jonathan Han
(74) *Attorney, Agent, or Firm* — Brinks Hofer Gilson & Lione

(57) ABSTRACT

A system comprises an audio processor adapted for communication with an audio source and a control cover. The audio processor may have a plurality of manual controls to adjust audio processing parameters based on selected states of the controls. The control cover may engage the audio processor to restrict movement of the manual controls and maintain the manual controls in their selected states. The audio processor may be a pedal-processor.

26 Claims, 7 Drawing Sheets

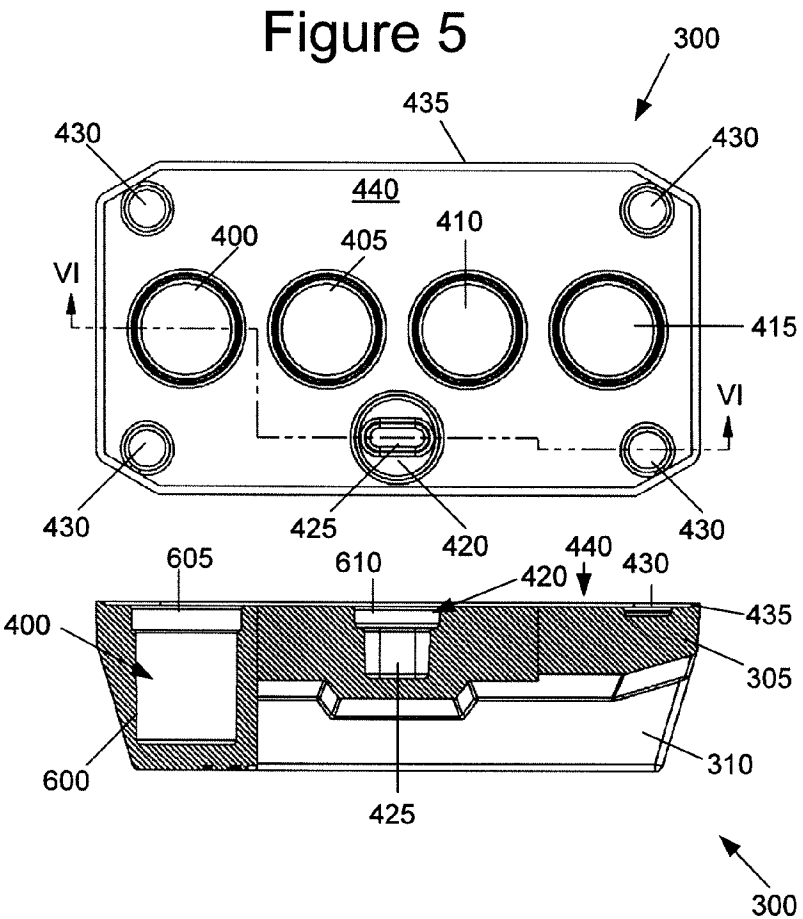
Figure 5
Figure 6
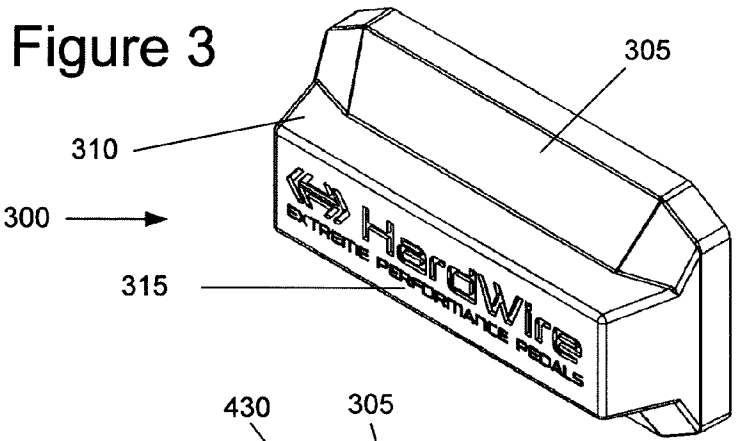
Figure 3
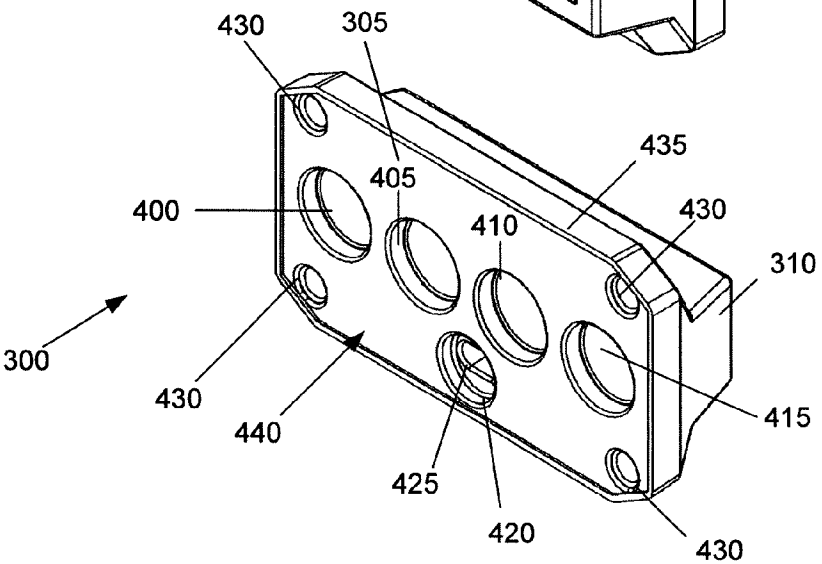
Figure 4

SYSTEM INCLUDING DEVICE FOR SECURING THE STATES OF ELECTRONIC CONTROLS

BACKGROUND OF THE INVENTION

1. Technical Field

The present application is directed to a system including a device for securing the states of electronic controls, such as the controls of an audio processing unit.

2. Related Art

Audio processors are used in a wide range of applications. The audio processors may include those used in studios as well as live performance venues. Pedal processors, such as bass guitar pedals, electric guitar pedals, acoustic guitar pedals, amplifier pedals, keyboard pedals, and other pedal processor types are used to control the audio characteristics of the audio ultimately produced by the respective instrument. Other audio processors include rack-mounted microphone/instrument preamplifiers, compressors, reverb processors, effects processors, and similar audio processor types.

Pedal processors may have controls that are manually adjustable to selected states to provide desired audio processing characteristics. A guitarist or other performer may have a particular set of adjustments to provide the desired characteristics. During a performance, however, the states of the controls may be upset through physical contact that may be ancillary to the performance. The states of the controls may also be disturbed during transportation of the pedal processor from one venue to another.

Rack-mounted processors may also have controls that are manually adjustable to selected states to provide desired audio processing characteristics. A studio and/or live mix engineer may have a particular set of control adjustments that are used to provide the desired audio characteristic. The engineer may find it difficult to maintain the control adjustments during the performance. The states of the controls may also be disturbed during transportation of the rack-mounted processors from one venue to another.

SUMMARY

A system comprises an audio processor adapted for communication with an audio source and a control cover. The audio processor may have a plurality of manual controls to adjust audio processing parameters based on selected states of the controls. The control cover may engage the audio processor to restrict movement of the manual controls and maintain the manual controls in their selected states. The audio processor may be a pedal-processor.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

FIG. 3 is a perspective view of a front of a control cover for use with the pedal processor of FIG. 2.

FIG. 4 is a perspective view of the rear of the control cover shown in FIG. 3.

FIG. 5 is a plan view of the rear of the control cover shown in FIG. 3.

FIG. 6 is a cross-section of view of the control cover shown in FIG. 3 taken along lines VI-VI of FIG. 5.

DETAILED DESCRIPTION OF THE PREFERRED EMBODIMENTS

Figure 1:
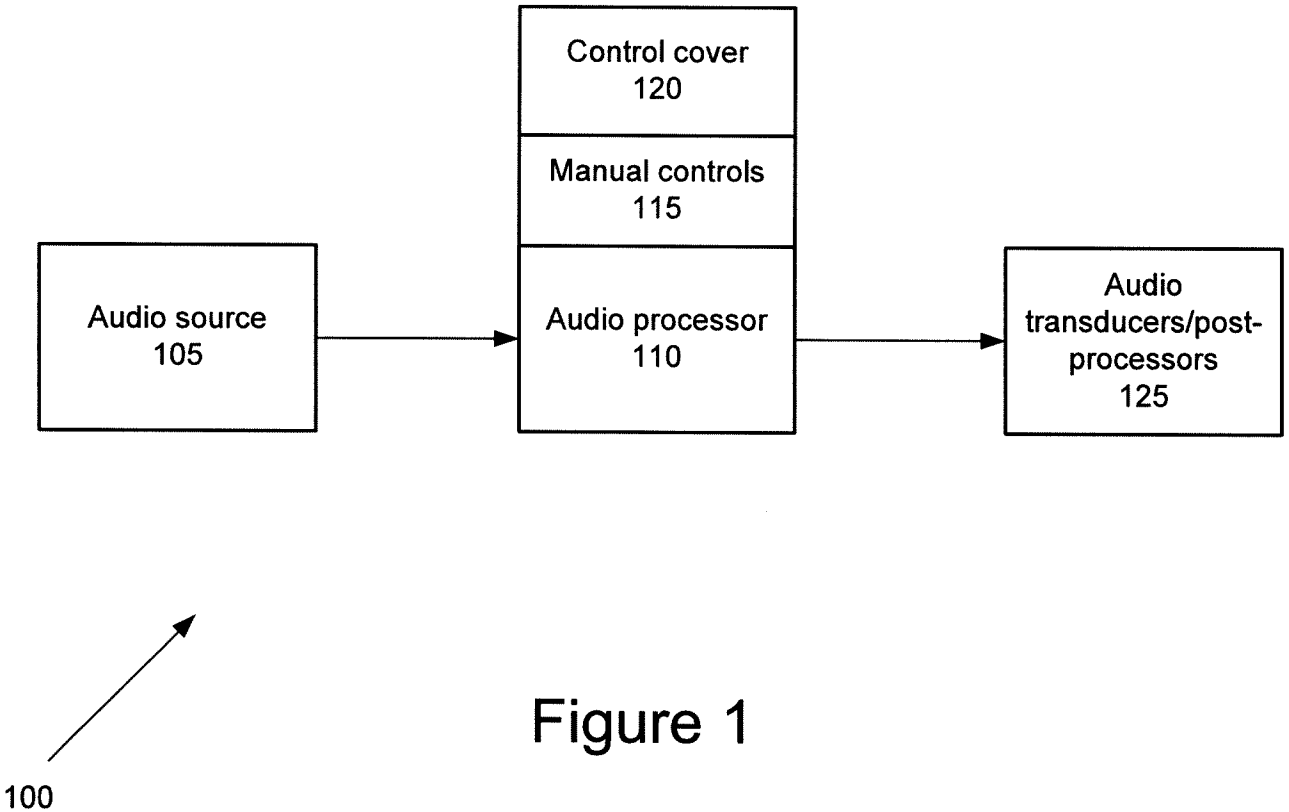
FIG. 1 is an audio system including a device for securing the states of electronic controls.

FIG. 1 is a system 100 that includes a device for securing the states of electronic controls. System 100 includes an audio source 105. The audio source 105 may be an instrument, such as a guitar, a keyboard, or other instrument having a digital and/or analog output. The audio source 105 may also include a microphone or other transducer. The audio source 105 communicates audio signals in an analog and/or digital format to an audio processor 110. The audio processor 110 may include a plurality of manual controls 115 that adjust the processing characteristics of the audio processor 110. Manual controls 115 are adjusted by a user to place the manual controls 115 in selected states that provide the audio characteristics desired by the user.

The audio processor 110 may include one or more audio processor types such as a compressor, preamplifier, reverb unit, effects processor, or similar audio processor. Mechanically, the audio processor 110 may be a pedal processor that includes a foot-actuated switch, a rack-mounted device, or other mechanical configuration.

A control cover 120 is provided to cover the manual controls 115. The control cover 120 may substantially inhibit access to the manual controls 115 after they have been set to their selected states and/or secure the manual controls 115 in the selected states. By covering the manual controls, movement and/or inadvertent adjustment of the manual controls 115 from the selected states is substantially inhibited. Depending on the particular configuration of the control cover 120, the states of the manual controls 115 may be maintained during transportation of the audio processor 110 from one venue to another and/or during a live performance.

System 100 may also include audio transducers, such as speakers, and/or post-processors 125. The transducers and/or post-processors are in communication with one or more output of the audio processor 110. The output of the audio processor 110 may be analog, digital, or a combination of both analog and digital signals. Post-processors used at 125 may also include manual controls with corresponding control covers.

Figure 2:
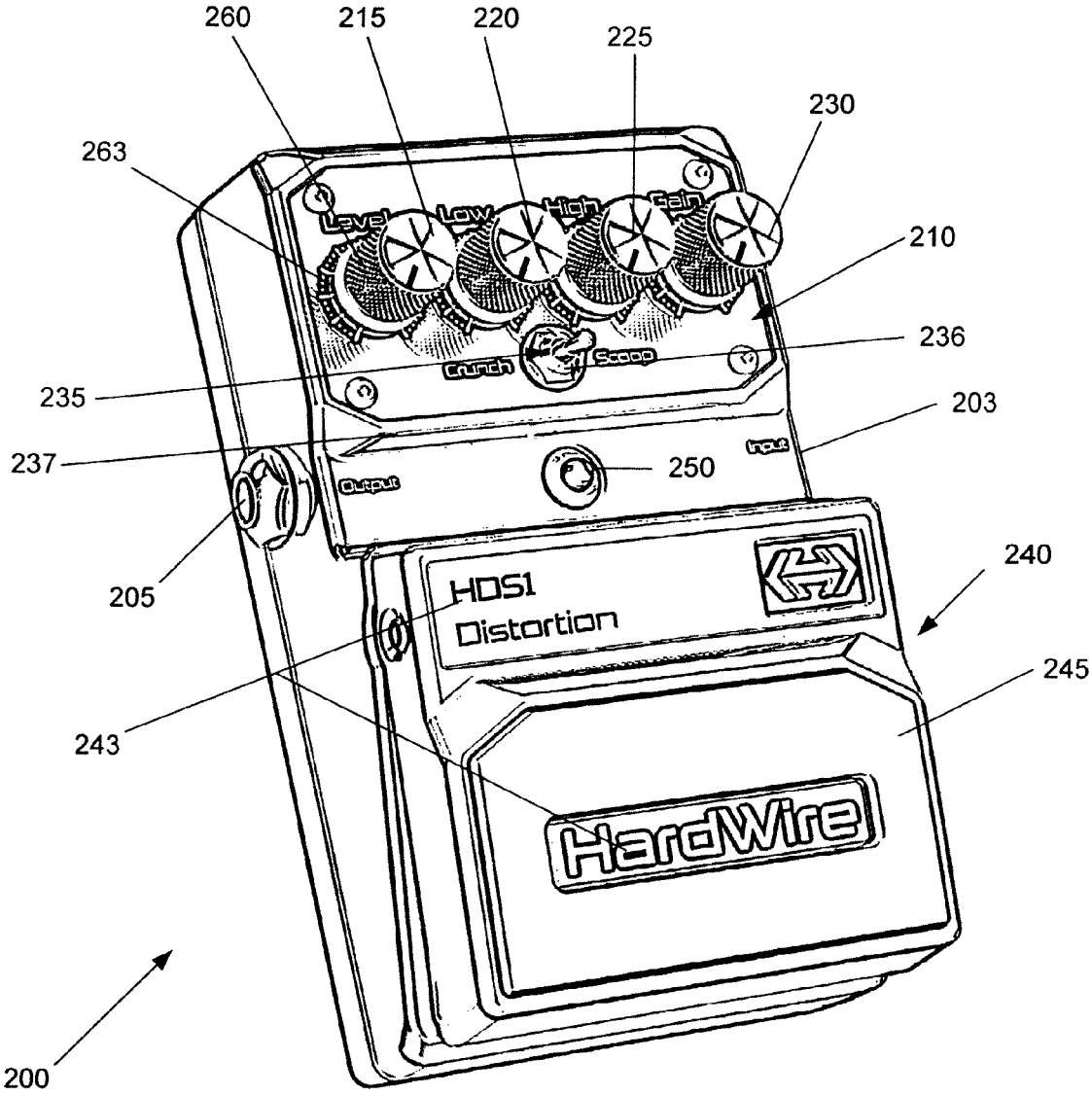
FIG. 2 is a perspective view of a pedal processor.

FIG. 2 is a pedal processor 200 that may be used for the audio processor 110 shown in FIG. 1. Pedal processor may include an input 203 for communication with the audio source 105 and an output 205 for communication with the transducers/post-processors 125. A first area 210 of the face of the pedal processor 200 includes a plurality of manual controls 215 through 235. The first area 210 may include a flange 237 that substantially surrounds the plurality of manual controls 215 through 235. A second area 240 of the face of the pedal processor 200 may include a foot-actuated switch 245. The second area 240 may include visual indicia 243 indicating the type and/or more region of the processing pedal 200. A lamp 250 may indicate whether the processing of the pedal processor 200 is actuated or bypassed.

Manual controls 215 through 230 are in the form of rotary controls that facilitate adjustment of the processing parameters of the pedal processor 200. A user rotates one or more of the manual controls 215 through 230 to angular states that may correspond to values of one or more processing parameters providing the audio characteristics desired by the user. Each manual control 215 through 230 may include knurling 260 to assist in the gripping the respective control and terminate at a respective flange 263 proximate a face of the pedal processor 200. Manual control 235 is a toggle switch that may be set to two or more switched states to alter the audio characteristics in a manner desired by the user. The toggle switch is fixed to the face of pedal processor 200 using a securement 236.

In FIG. 2, the pedal processor 200 may be a distortion pedal for a guitar or other instrument. Manual control 215 may be used to adjust the level of distortion. Manual controls 220 and 225 may be used to adjust the low-frequency components and high-frequency components, respectively, of the output signal of the pedal processor 200. Manual control 230 may be used to adjust the gain of distortion provided by the pedal processor 200. Manual control 235 may be used to adjust the type of distortion provided by the pedal processor 200.

FIGS. 3 through 6 show various views of a control cover 300 that may be used with the pedal processor 200 shown in FIG. 2. FIG. 3 is a perspective view of one side of the control cover 300. The control cover 300 may include a body portion 305 and a gripping portion 310. The gripping portion 310 may be dimensioned to facilitate user manipulation of the control cover 300, such as its installation and/or removal to and from the pedal processor 200. Body portion 305 may be dimensioned to correspond to the dimensions of the second area 210 of the pedal processor 200. Visual indicia 315 may be provided on the control cover 300 indicative of the pedal processor 200 to which it belongs. The visual indicia 315 may allow the user to pair the control cover 300 with the corresponding pedal processor 200 and may correlate with the visual indicia 243 of the pedal processor 200.

FIG. 4 is a perspective view of another side of the control cover 3300 and FIG. 5 is a plan view of that side. As shown, the control cover 300 includes a plurality of openings 400 through 420 adapted to cover manual controls 215 through 235 of the pedal processor 200. Openings 400 through 415 are adapted to cover manual controls 215 through 230, respectively. Opening 420 is adapted to cover manual control 235. In those instances in which the manual control 235 is a toggle switch, an additional slot 425 may be provided in opening 420 to cover the stem of the toggle switch. Slot 425 may be dimensioned to accommodate the full range of the motion of the stem through all of its selectable states. Additional openings 430 may be provided to accommodate fasteners on the face of the pedal processor 200 so that the fasteners do not substantially interfere with use and/or placement of the control cover 300. A flange 435 may substantially circumvent face 440. Flange 435 may be dimensioned to extend about an exterior portion of flange 237.

FIG. 6 is a cross-sectional view of the control cover 300 taken along lines VI-VI of FIG. 5. As shown, opening 400 (as well as other openings 405 through 415) may include a main opening 600 dimensioned to accommodate the principal portion of manual control 215 and a base portion 605 dimensioned to accommodate flange 263 of the manual control 250. Opening 420 may include slot 425 dimensioned to accommodate the stem of the toggle switch 235 and a base portion 610 dimensioned to accommodate the securement 236 used to fix the toggle switch 235 to the face of the pedal processor 200. Openings 400 through 420 may extend partially through the body portion 305 and/or gripping portion 310 of the control cover 300. Alternatively, some or all of the openings 400 through 420 may extend completely through the body portion 305 and/or gripping portion 310 so that the states of the corresponding manual controls may be viewed.

Figure 7:
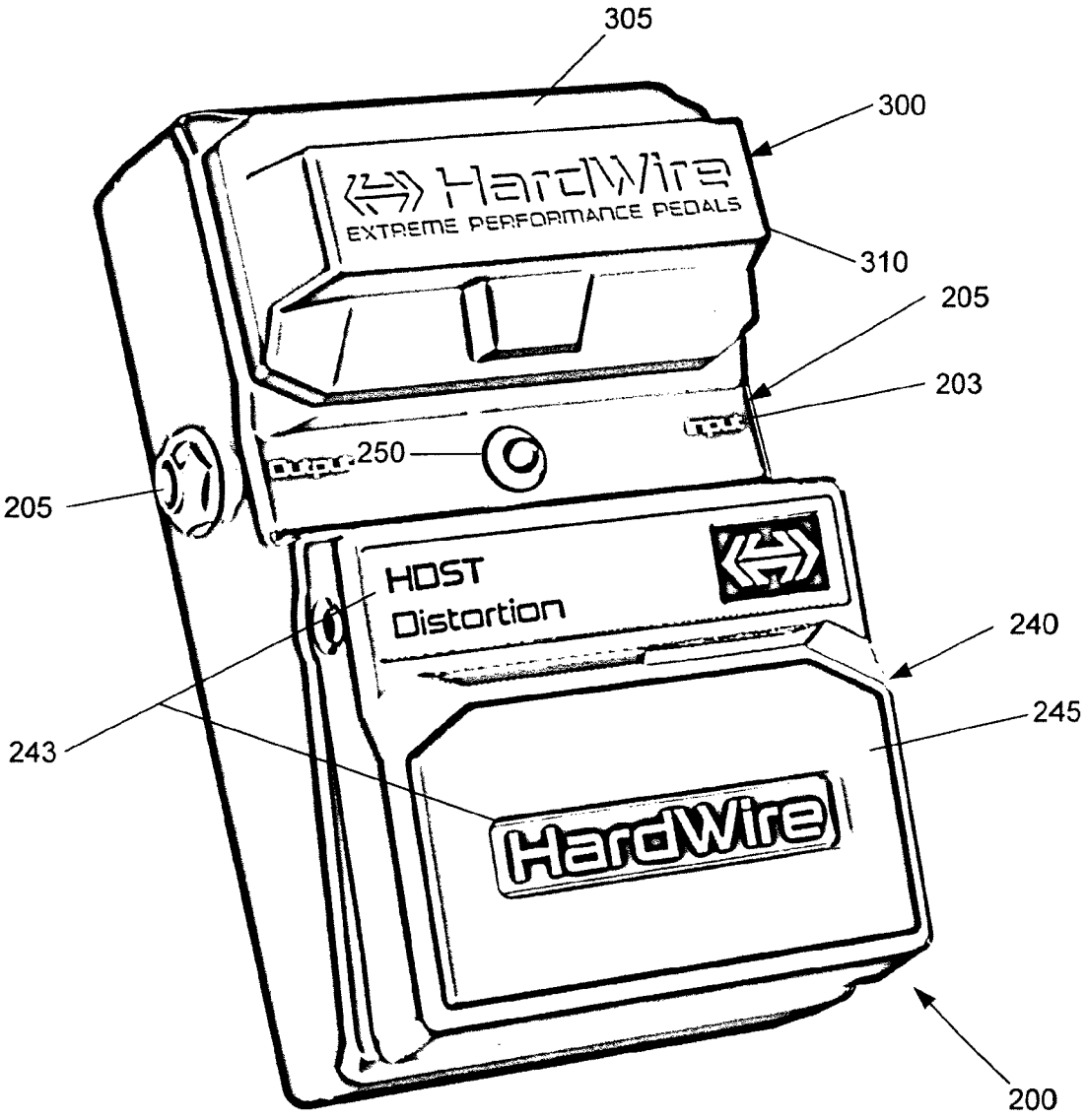
FIG. 7 is a perspective view of the pedal processor of FIG. 2 with the control cover in place.

Once the manual controls 215 through 235 have been set to the desired selected states, the control cover 300 may be placed over the manual controls to prevent access to them and/or inhibit movement from the selected states. Control cover 300 may engage the pedal processor 200 in a number of different manners. A latch or other securement member may be provided to hold the control cover 300 at a position to cover the manual controls 215 through 235. Additionally, or in the alternative, one or more portions of the control cover 300 may be dimensioned to frictionally engage corresponding portions of the pedal processor 200. For example, one or more of the openings 400 through 415 may be dimensioned to frictionally engage the outer surface of the corresponding manual control 215 through 235. This frictional engagement may be used to inhibit and/or prevent movement of the manual controls 215 through 235 from their selected positions. Additionally, or in the alternative, flange 435 may be dimensioned to frictionally engage flange 237 of pedal processor 200. FIG. 7 shows the control cover 300 positioned on the pedal processor 200.

Figure 8:
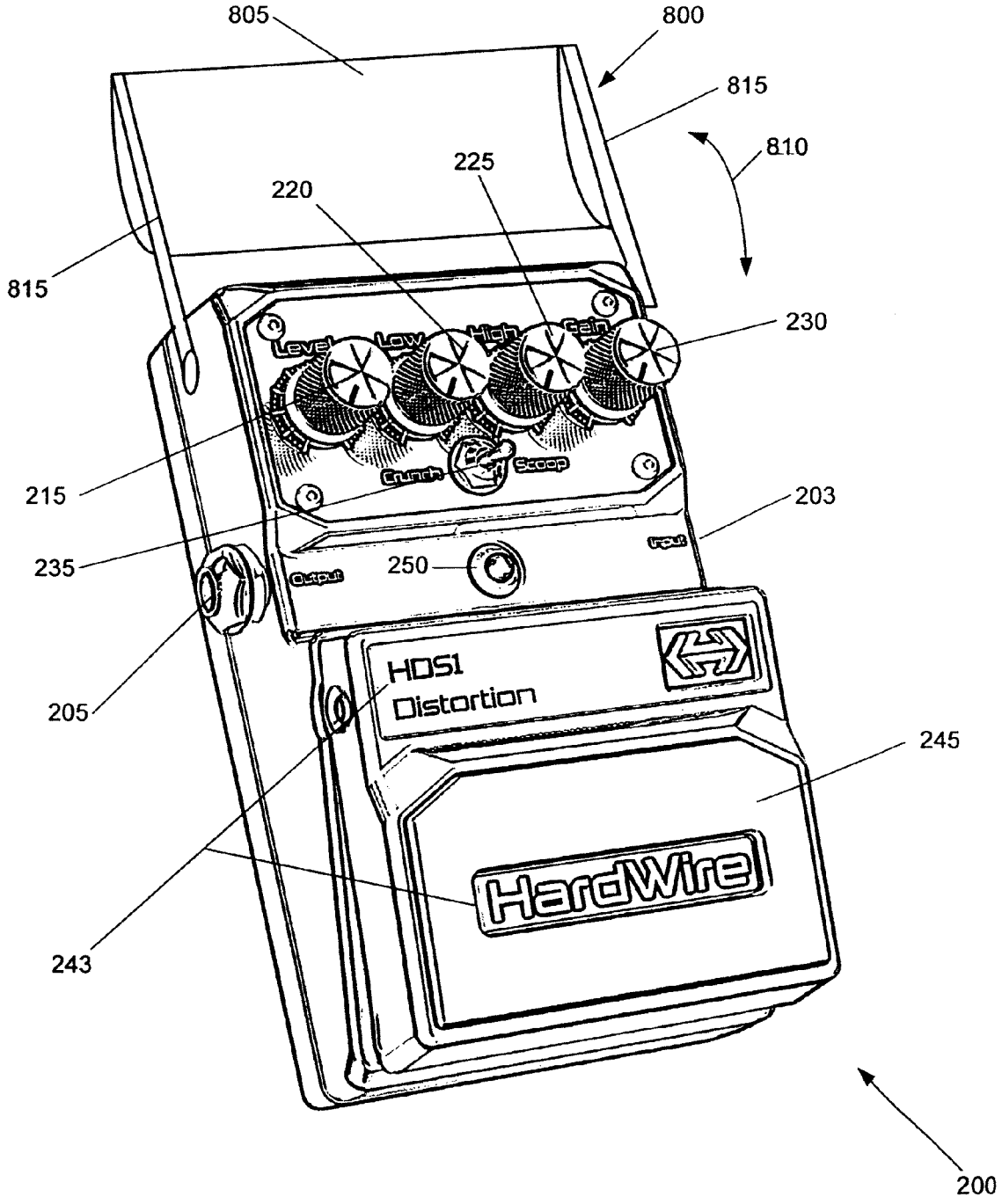
FIG. 8 is a perspective view of the pedal processor of FIG. 2 with a rotatable control cover.

FIG. 8 shows another control cover 800 used to inhibit access to manual controls 215 through 235. The control cover 800 may include a shield 805 that is rotatable between first and second positions as shown by arrows 810. In the first position shown in FIG. 8, the shield 805 is in a position to expose the manual controls 215 through 235 for manipulation by a user. In the second position (not shown), the shield 805 is rotated to cover the manual controls 215 through 235 to restrict motion of manual controls by inhibiting further manipulation of the controls from their selected states. The shield 805 may be translucent to facilitate viewing of the states of the manual controls 215 through 235. In FIG. 8, the shield 805 is secured with the pedal processor 200 by one or more support arms 815. The support arms 815 may have a first end in fixed alignment with the pedal processor 200 and a second end in fixed alignment with the shield 805. The support arms 850 may be rotatable about their respective first ends to facilitate rotation of the shield 805 between the first and second positions.

Figure 9:
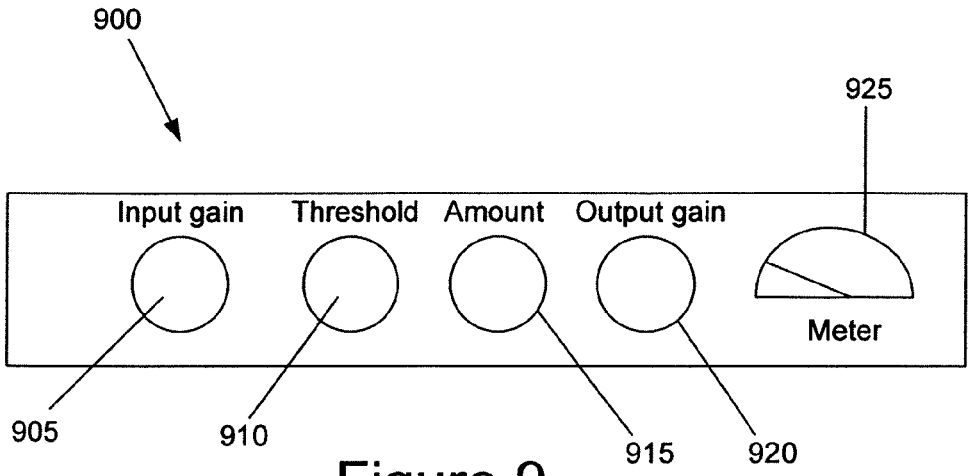
FIG. 9 is a front plan view of a rack-mountable audio processor.
Figure 10:
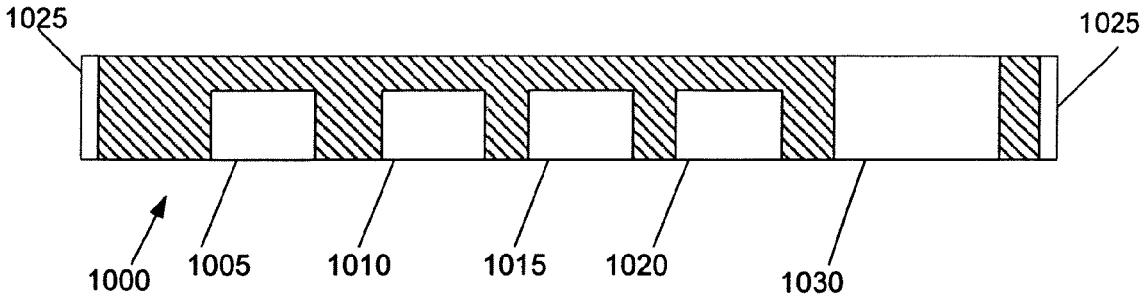
FIG. 10 is a cross-sectional view of a control cover that may secure the manual controls of the audio processor shown in FIG. 9.

FIG. 9 is a rack-mounted audio processor 900 and FIG. 10 is a corresponding control cover 1000 that may be used with processor 900. Although other rack-mounted audio processors may be used, the rack-mounted audio processor 900 of FIG. 9 may be a compressor that includes a plurality of manual controls 905 through 920. Control 905 may control input gain to the compressor. Control 910 may be used to adjust the threshold at which the compressor begins its compression operation. Control 915 may be used to set the amount of compression, and control 920 may be used to adjust the output gain of the compressor. A meter 925 may be used to monitor the input signal level, the output signal level, and/or the amount of compression.

Control cover 1000 includes a plurality of openings 1005 through 1020 that are dimensioned to accommodate manual controls 905 through 920. One or more of the openings 1005 through 1020 may frictionally engage the corresponding manual controls 905 through 920 to secure the control cover 1000 with the rack-mounted processor 900. Additionally, or in the alternative, elastic latches and/or flanges 1025 may be provided to engage a face of the rack-mounted processor 900.

It may be desirable to monitor the rack-mounted processor 900 during its operation. Meter 925 may be used for this purpose. Accordingly, control cover 1000 may include an opening 1030 through which meter 925 may be viewed. Opening 1030 may be entirely exposed meter 925 or be provided with a translucent cover through which the meter 925 may be viewed. Similarly, openings 1005 through 1020 may extend completely through the cover 1000 to expose the corresponding manual controls 905 through 920. Translucent covers may also be provided over openings 1005 through 1020 to facilitate viewing.

Audio processors may have exposed surfaces that may be subject to damage during use and/or transport. Some of these surfaces may include aesthetically pleasing designs, colored surfaces, indicia indicative of functions executed by the audio processor and/or certain controls, or similar surfaces. Accordingly, the corresponding control cover may be dimensioned to cover areas of the audio processor proximate and/or beyond the area of the manual controls. In such instances, the control cover may protect these areas from scratching or other damage that may occur during use and/or transport of the audio processor.

Figure 11:
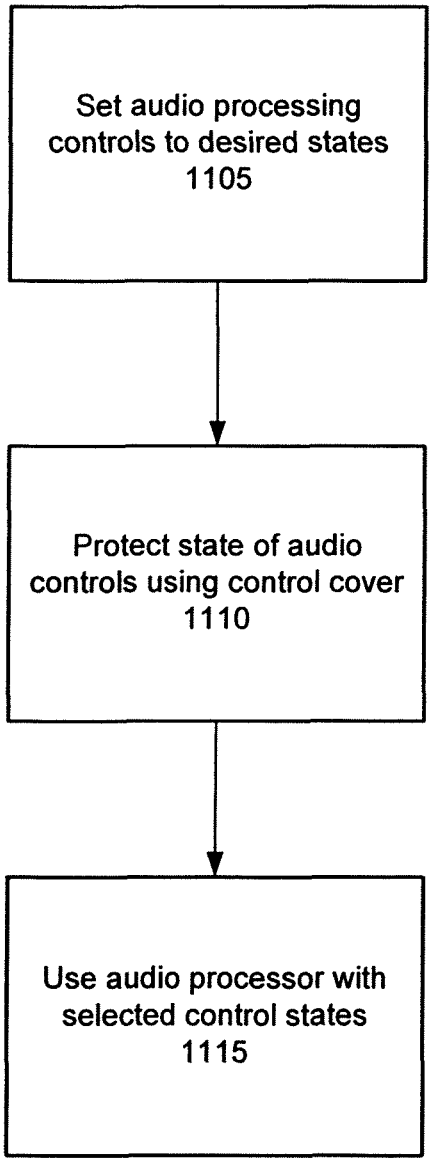
FIG. 11 is a process that may be executed using an audio processor and corresponding control cover.

FIG. 11 is a method corresponding to use of a control cover in conjunction with an audio processor. At 1105, the audio processing controls of the audio processor are set to the desired states by the user. At 1110, the desired states of the audio controls are protected using a control cover. The audio processor is used with the selected control states at 1115.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A system comprising:

an audio processor adapted for communication with an audio source, where the audio processor has a user actuated switch and a plurality of manual controls to adjust audio processing parameters based on selected states of the plurality of manual controls; and a control cover adapted to engage the audio processor where the control cover is adapted to restrict movement of the plurality of manual controls to maintain the plurality of manual controls in the selected states, and where the user actuated switch is accessible to a user while the control cover is engaged.

2. The system of claim 1, where the control cover comprises:

a body portion; and a plurality of openings disposed in, the body portion positioned to frictionally engage corresponding controls of the plurality of manual controls.

3. The system of claim 2, where the audio processor comprises a flange substantially surrounding the plurality of manual controls, and where the body portion comprises a flange frictionally engaging the flange of the audio processor.

4. The system of claim 1, where the control cover comprises visual indicia indicative of the audio processor for which the control cover is designed.

5. The system of claim 2, further comprising a manual grip extending from the body portion.

6. The system of claim 1, where the control cover comprises a shield rotatable between a first position allowing access to the plurality of manual controls and a second position substantially preventing access to the plurality of manual controls.

7. The system of claim 6, further comprising a support arm having a first end in fixed alignment with the audio processor and a second end in fixed alignment with the shield, where the support arm is rotatable about the first end to facilitate rotation of the shield between the first and second positions.

8. The system of claim 6, where the shield comprises a translucent portion that facilitates viewing of the plurality of manual controls when the shield is in the second position.

9. The system of claim 1, where the audio processor comprises a guitar pedal having a first area including the plurality of manual controls and a second area comprising a foot actuated switch.

10. A system comprising:

a pedal processor having a first area including a plurality of manual controls and a second area comprising a foot actuated switch, where the plurality of manual controls are manipulated to selected states to adjust audio processing parameters of the pedal processor; and a control cover adapted for engagement with the pedal processor, where the control cover is adapted to restrict movement of the plurality of manual controls to maintain the selected states of the plurality of manual controls while the second area remains uncovered by the control cover.

11. The system of claim 10, where the control cover comprises:

a body portion; and a plurality of openings disposed in the body portion positioned to fictionally engage corresponding controls of the plurality of manual controls.

12. The system of claim 11, where the pedal processor comprises a flange substantially surrounding the plurality of manual controls, and where the body portion comprises a flange frictionally engaging the flange of the pedal processor.

13. The system of claim 10, where the control cover comprises visual indicia indicative of the pedal processor for which the control cover is designed.

14. The system of claim 11, further comprising a manual grip extending from the body portion.

15. The system of claim 10, the control cover comprises a shield rotatable between a first position allowing access to the plurality of manual controls and a second position substantially preventing access to the plurality of manual controls.

16. The system of claim 15, where the shield comprises a translucent portion that facilitates viewing of the plurality of manual controls when the shield is in the second position.

17. The system of claim 10, where the pedal processor comprises a guitar pedal.

18. A control cover for use with a pedal processor, the pedal processor having a first area including a plurality of manual controls and a second area comprising a foot actuated switch, where the plurality of manual controls are manipulated to selected positions to adjust audio processing parameters of the pedal processor, the control cover comprising:

a body portion; and a plurality of openings disposed in the body portion positioned to substantially inhibit access to corresponding controls of the plurality of manual controls where the plurality of openings are dimensioned to allow the body portion to frictionally engage one or more of the plurality of manual controls to restrict movement of the one or more of the plurality of manual controls and where the control cover is dimensioned such that access to the second area is unrestricted.

19. The system of claim 18, where the pedal processor comprises a flange substantially surrounding the plurality of manual controls, and where the body portion comprises a flange frictionally engaging the flange of the pedal processor.

20. The system of claim 18, where the control cover comprises visual indicia indicative of the pedal processor for which the control cover is designed.

21. A system for use with an audio processor comprising a control cover adapted for engagement with the audio processor, where the control cover is adapted to restrict movement of a plurality of manual controls of the audio processor to maintain the selected states of the plurality of manual controls, and the control cover is adapted to allow unrestricted user access to an actuated switch of the audio processor while the movement of the plurality of manual controls is restricted.

22. The system of claim 21, where the control cover comprises:

a body portion; and a plurality of openings disposed in the body portion positioned to frictionally engage corresponding controls of the plurality of manual controls.

23. The system of claim 22, where the audio processor comprises a pedal processor.

24. An apparatus for use with an audio processor comprising a cover adapted for removable engagement with the audio processor, where the control cover is dimensioned to protect one or more surfaces of the audio processor to maintain settings of the audio processor while a setting of an actuated switch of the audio process remains user switchable.

25. The apparatus of claim 24, where the cover comprises:

a body portion; and a plurality of openings disposed in the body portion positioned to frictionally engage corresponding controls of a plurality of manual controls of the audio processor.

26. The apparatus of claim 24, where the audio processor comprises a pedal processor.

* * * * *